US005441426A

United States Patent [19]

Boulais

[11] Patent Number: 5,441,426

[45] Date of Patent: Aug. 15, 1995

[54] INDEXABLE CODING DEVICE AND A CONNECTION DEVICE COMPRISING THE SAME

[75] Inventor: Guillaume Boulais, Boulogne Billancourt, France

[73] Assignee: Framatome Connectors International, Paris, France

[21] Appl. No.: 164,205

[22] Filed: Dec. 9, 1993

[30] Foreign Application Priority Data

Dec. 16, 1992 [FR] France ..... 92 15155

[51] Int. Cl.[6] ..... H01R 13/64

[52] U.S. Cl. ..... 439/681; 439/680

[58] Field of Search ..... 439/680, 681, 682, 692, 439/701, 677–679

[56] References Cited

U.S. PATENT DOCUMENTS 3,491,330 1/1970 Barnhart et al. ..... 439/681
3,714,617 1/1973 Bright et al. ..... 439/681
3,950,059 4/1976 Anhalt et al. ..... 439/681
3,951,500 4/1976 Anderson ..... 439/680
4,925,400 5/1990 Blair et al. ..... 439/681

*Primary Examiner*—Neil Abrams
*Assistant Examiner*—Hien D. Vu
*Attorney, Agent, or Firm*—Perman & Green

[57] ABSTRACT

The invention concerns an indexable coding device for an electronic connector having a correction component (30) having a rear part (31) comprising a right prism of which at least one of the lateral faces makes up an angular indexing positioning reference surface, and an elongated front part (32) extending in a longitudinal direction and having a correction profile. According to the invention, it has a holding element (3, 8) for correction component (20, 30) said holding element (3, 8) comprising a lateral indexing means (11, 35, 36) having at least two lateral indexing positions spaced laterally with regard to one another to hold correction component (20, 30) according to one of the lateral indexing positions.

7 Claims, 2 Drawing Sheets

A
A'

INDEXABLE CODING DEVICE AND A CONNECTION DEVICE COMPRISING THE SAME

BACKGROUND OF THE INVENTION

The present invention concerns a device for indexable coding for an electrical connector of the type comprising a correction component having a rear part comprising a right prism of which at least one of the lateral faces constitutes an angular positioning reference surface for indexing as well as an elongated front part extending in a longitudinal direction and having a correction profile.

Indexable coding devices of this type are currently used in the connection field, in particular for connectors designed for aviation.

It is desirable to increase the number of correction positions, which is currently feasible only at the price of a certain complication, thus resulting in a relatively high cost.

SUMMARY

The present invention pertains to an indexable coding device permitting realizing correction functions with a higher number of codes, while limiting the space occupied by the device.

The invention thus concerns an indexable coding device of the type mentioned above, characterized in that it comprises an element for holding the correction component, said holding element comprising a lateral indexing means having at least two lateral indexing positions spaced laterally with regard to one another, to hold the correction component according to one of the lateral indexing positions.

The device according to the invention permits resolving the above-mentioned problem, by using standard correction components, therefore, without necessitating the manufacture of special parts, and only at the price of a minor mechanical modification, while possibly being compatible with smaller connectors. The holding element can comprise an angular indexing groove extending laterally. This groove permits realizing angular indexing of the holding element in each of its lateral indexing positions.

The lateral indexing means can advantageously comprise at least two casings for the holding element, for example being made part of the same opening, which is roughly in the form of an 8.

Said rear part of the correction component can comprise a cylindrical part to engage in one said casing.

The indexable coding device can also comprise a cylindrical guide held by said holding element.

The invention also concerns a connection device having two connection elements, i.e. a pin and a base, characterized in that the pin and the base each have a coding device such as defined above.

According to one mode of embodiment, one of the coding devices has a cylindrical guide held by said holding element, and the other coding device has a cylindrical opening in order to receive said cylindrical guide.

The holding element of one of the coding devices can advantageously have two casings and the holding element of the other coding device can then have a single casing, said two lateral indexing positions being obtained by inverting this latter holding element.

According to a preferred mode of embodiment, the holding element of one of the coding devices has an angular indexing groove extending laterally, while, for the other coding device, the connection element which corresponds to it has a transverse angular indexing groove in which is positioned the right prism of the corresponding correction element.

BRIEF DESCRIPTION OF THE DRAWINGS

Other characteristics and advantages of the invention will become more apparent after reading the description which follows, given by way of non-limiting example, in combination with the drawings which show.

DETAILED DESCRIPTION OF THE INVENTION

Figures 1A, 1B, 2A, 2B:
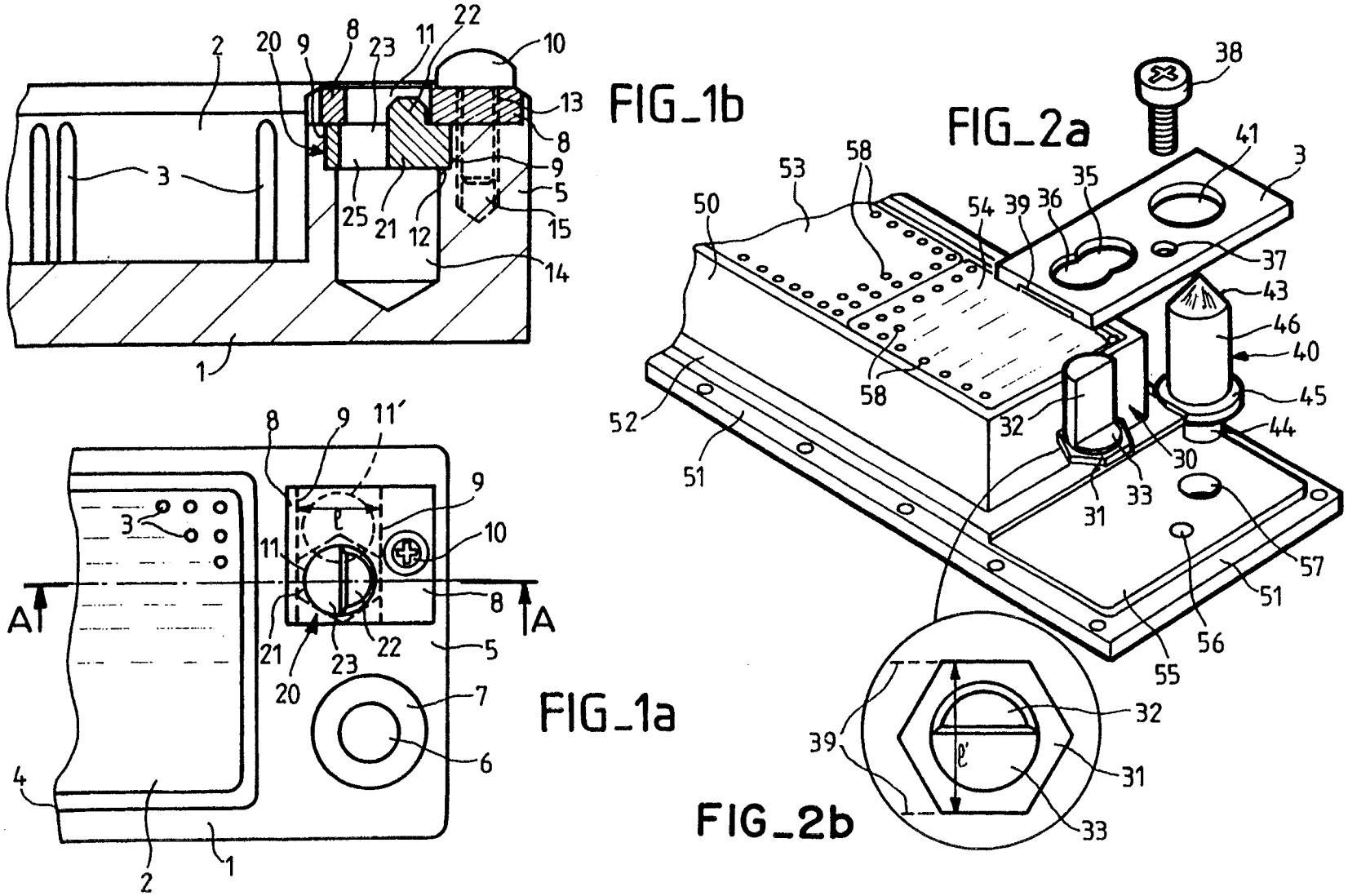
FIG. 1*a*, a top view of a base according to a preferred mode of embodiment of the invention, FIG. 1*b*, a section according to A—A of the base of FIG. 1*a*, FIG. 2*a*, a broken apart perspective view of a pin according to a preferred mode of embodiment of the invention.
FIG. 2*b*, a top view with an enlarged insert of a correction component.

In FIGS. 1*a* and 1*b*, base 1 has an inner casing for one or several male contact groups 3 and has, at one end 5, a transverse groove 9 of width l as well as a bore 15 situated roughly at the median part of groove 9. A holding plate 8 has a cylindrical opening 11 whose center is shifted laterally with regard to the axis of an opening 13 designed to receive an attachment screw 10 screwed into bore 15. A correction component 20 has a lower part 21 of hexagonal section, and an upper part 22 in the form of a half-moon to form a male correction means with hermaphrodite profile. The distance between two parallel faces of hexagonal part 21 is roughly equal to l. The correction means can be indexed in groove 9 according to six different angular positions. When plate 8 is held by screw 10, upper part 22 precisely fits half the contour of opening 11 in which it can take the six above-mentioned positions. Plate 8 can be mounted in the position shown in FIG. 1*a* or even, by turning, in the position where opening 11 is shown by the dotted lines of FIG. 1*a*. Under these conditions, given that the axis of opening 11 is shifted laterally or offset with regard to the axis of opening 13, the inversion that occurs from turning or flipping the plate 8 permits obtaining a second possible lateral position for opening 11′ shifted with regard to the preceding position 11. In this inverted position, correction component 20 can also be positioned according to any one of six angular positions, which now permits bringing to 12 the number of angular correction positions.

It is also observed in FIG. 1*a* that a one-eyed hole or opening 6 is designed to receive a cylindrical guide, known in and of itself, this one-eyed hole 6 being bordered by a cylindrical facing 7.

FIG. 2 shows a pin having a plate 51 having an edge 52 extended by a case 50 surrounding one or several regions 53, 54 in which are positioned female contacts. At one end of plate 51, edge 52 is extended by an edge 55 in which are arranged a bore 56 designed to receive a screw 38 and a one-eyed hole 57 designed to receive the rear cylindrical part of 44, a cylindrical indexing guide 40 having a collar 45 and a front cylindrical part 46 which is terminated by a truncated front profile 43.

Referring also to FIG. *2a*, the correction component 30, which can be used alone or in combination with above-mentioned cylindrical guide 40, has an extended front part 32 having a half-moon correction profile (hermaphrodite type correction) and a rear part 31 of hexagonal section to permit its indexing according to six angular positions displaced by 60°. Between front part 32 and rear part 31, a cylindrical part 33 is arranged. One holding plate 3 comprises, roughly in its median plane, an opening 37 permitting the passage of screw 38 for attachment of holding plate 3 at 56 on the pin, and two openings 35 and 36 whose diameter is roughly equal to that of cylindrical part 33 (and half-moon part 32) and which are displaced with regard to one another in lateral directions with regard to correction component 30 with an in-between axis nominally equal to in-between axis mentioned above in FIG. 1*a* and 1*b*). Plate 3 also has in its lower part a laterally extending angular indexing groove or transverse groove 39 extending over the entire length of plate 3 whose width l' is roughly equal to the distance between two parallel faces of hexagonal base 31 (see insert). Width l' can be equal or not equal to above-mentioned width l (FIGS. 1*a* and 1*b*).

Figure 3:
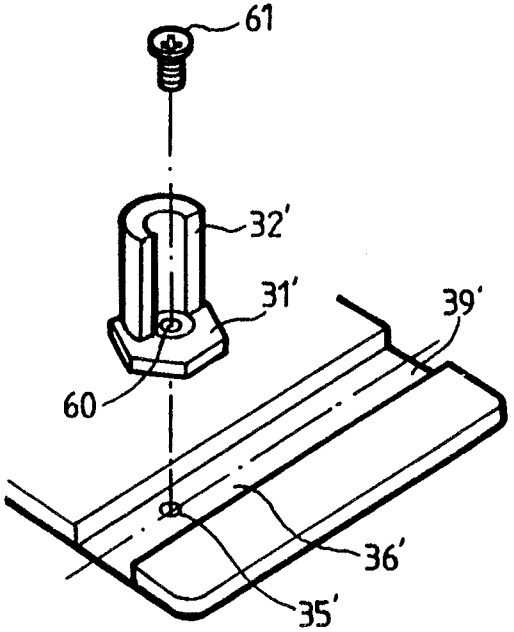
FIG. 3, an exploded perspective view of a variant of the invention.

In the variant of FIG. 3, a groove 39' can be supported by edge 55, rear part 31' of a correction element having a semi-cylindrical front part 32' having an opening 60 for an attachment screw 61 in two indexing threads 35', 36' laterally spaced with regard to one another in groove 39'.

The mounting of the coding device (FIG. 2) is effected in the following manner: front part 32 is introduced into one of the two openings 35, 36, plate 3 is attached by screw 38, with possible use of guide 40 whose front part 46 crosses an opening 41 of plate 3 and which is held by its collar 45. Openings 35 and 36 permit two lateral positions spaced apart from one another for correction component 30, in correspondence with the two possible positions for the base. In FIG. 2 are shown two casings 35 and 36 communicating in such a way as to form a single opening in the form of an 8. It goes without saying that one can use the two openings 35 and 36 separately. Moreover, it is observed that cylindrical part 33 can be eliminated, and front part 32 in half-moon profile can be sufficient for assuring the holding in position of correction component 30, in particular when the two casings 35 and 36 are separate or even connected together over a small part of their contour.

Figure 4C:
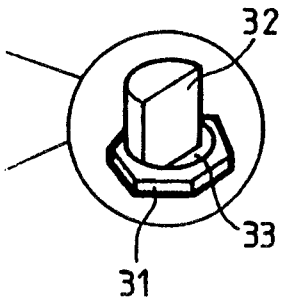
FIG. 4*a*, a partial sectional view of a variant of the invention.
FIG. 4*b*, a partial sectional view of a variant of the invention for mating with the variant shown in FIG. 4*a*, and FIG. 4*c*, a perspective view of the connection component shown in FIGS. 4*a* and 4*b*.
Figure 4A:
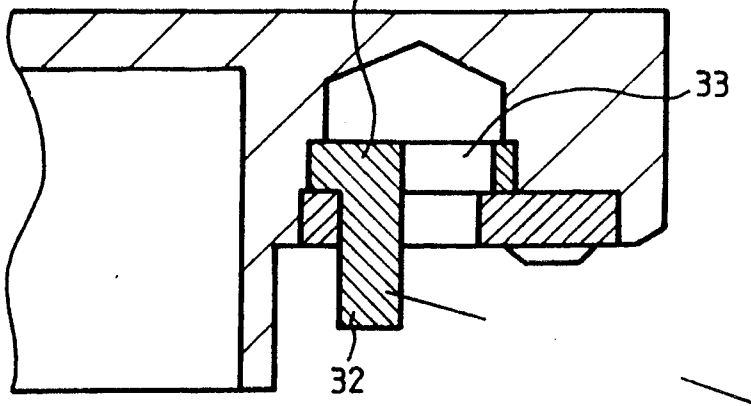
Figure 4B:
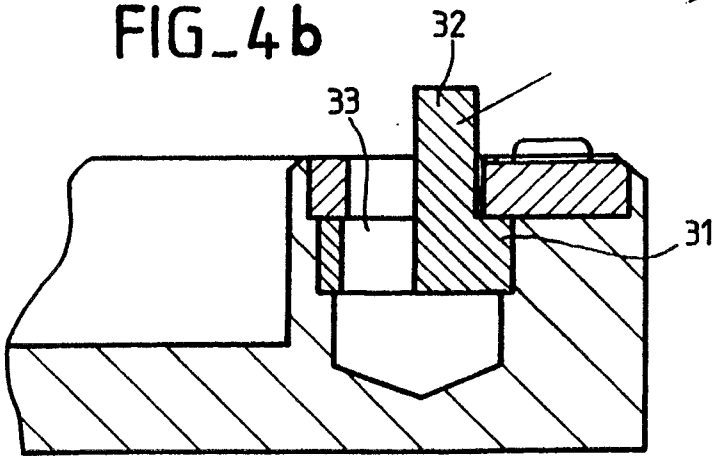

According to the variant of FIGS. 4*a*, 4*b* and 4*c*, part 33 of correction component 30 is hollow, and two identical correction components 30 are used, and in particular can be mounted in an identical manner, which makes the correction system entirely hermaphroditic.

I claim:

1. An indexable coding device for an electronic connector, the coding device having a correction component having a rear part comprising a right prism of which at least one of the lateral faces constitutes an angular indexing positioning reference surface, and an extended front part extending in a longitudinal direction and having a correction profile, characterized in that the coding device has a holding element (3) for the correction component (30), said holding element (3) comprising a lateral indexing means (35, 36) having at least two lateral indexing openings displaced laterally with regard to one another to hold the correction component (30) according to one of the at least two lateral indexing positions, the holding element having a laterally extending angular indexing groove (39).

2. An indexable device according to claim 1, further characterized in that the extended front part (32) is of a hermaphrodite type.

3. An indexable device according to claim 1, further characterized in that the two openings are part of the same opening (35, 36) roughly in the shape of an 8.

4. An indexable device according to claim 1, further characterized in that said rear part of the correction component has a cylindrical part (33) to engage in said openings (35, 36).

5. An indexable device according to claim 1, further characterized in that it also has a cylindrical guide (40) held by said holding element (3).

6. An indexable coding device for an electrical connector comprising:

a correction component having a rear portion with lateral faces forming angular indexing positioning reference surfaces, and a front part having a correction profile; and a holding element for holding the correction component, the holding element having a lateral indexing means with a general "8" shaped opening, the opening forming two lateral indexing positions spaced laterally with regard to one another to hold the correction component according to one of the lateral indexing positions.

7. A connection device having two electrical connection elements, each electrical connection element comprising:

a correction component having a rear portion with lateral faces forming angular indexing positioning reference surfaces, and a front part having a correction profile; and a holding element for holding the correction component, the holding element comprising a lateral indexing means having at least two lateral indexing positions, spaced laterally with regard to one another, to hold the correction component according to one of the lateral indexing positions, wherein the holding element of a first one of the electrical connection elements has a laterally extending angular indexing groove and a second one of the electrical connection elements has a transverse angular indexing groove in which is positioned the rear portion of the corresponding correction component.

* * * * *